US010843463B2

(12) United States Patent
Yamasaki et al.

(10) Patent No.: US 10,843,463 B2
(45) Date of Patent: Nov. 24, 2020

(54) LIQUID EJECTING HEAD AND LIQUID EJECTING APPARATUS

(71) Applicant: SEIKO EPSON CORPORATION, Tokyo (JP)

(72) Inventors: Sosuke Yamasaki, Matsumoto (JP); Hitoshi Takaai, Azumino (JP); Yuma Fukuzawa, Matsumoto (JP); Yoshinobu Toyama, Sakata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/549,228

(22) Filed: Aug. 23, 2019

(65) Prior Publication Data

US 2020/0070516 A1 Mar. 5, 2020

(30) Foreign Application Priority Data

Aug. 28, 2018 (JP) ..... 2018-159202

(51) Int. Cl.
*B41J 2/14* (2006.01)
*B41J 2/055* (2006.01)

(52) U.S. Cl.
CPC ..... *B41J 2/14201* (2013.01); *B41J 2/055* (2013.01); *B41J 2/1433* (2013.01); *B41J 2002/14241* (2013.01); *B41J 2002/14491* (2013.01)

(58) Field of Classification Search
CPC ..... B41J 2/14201; B41J 2/055; B41J 2/1433; B41J 2002/14491; B41J 2002/14241; B41J 2002/14419; B41J 2/14233
USPC ..... 347/65
See application file for complete search history.

(56) References Cited

U.S. PATENT DOCUMENTS 6,497,477 B1 * 12/2002 Nakamura ..... B41J 2/14233 347/70
2014/0267499 A1 * 9/2014 Kato ..... B41J 2/1623 347/50
2014/0292942 A1 10/2014 Torimoto et al.

FOREIGN PATENT DOCUMENTS

JP 2014-188782 A 10/2014

* cited by examiner

*Primary Examiner* — Huan H Tran
*Assistant Examiner* — Alexander D Shenderov
(74) *Attorney, Agent, or Firm* — Workman Nydegger

(57) ABSTRACT

A liquid ejecting head that includes a first piezoelectric element and a second piezoelectric element, a first wire that extends in a first direction and that electrically couples the first piezoelectric element and a wiring substrate to each other, and a second wire that is adjacent to the first wire in a second direction intersecting the first direction and that extends in the first direction, the second wire electrically coupling the second piezoelectric element and the wiring substrate to each other. A first protrusion is formed on a surface of the first wire in a mounting area to where the wiring substrate is joined, and a second protrusion is formed on a surface of the second wire in the mounting area and at a position different from that of the first protrusion in the first direction.

5 Claims, 10 Drawing Sheets

LIQUID EJECTING HEAD AND LIQUID EJECTING APPARATUS

The present application is based on, and claims priority from JP Application Serial Number 2018-159202, filed Aug. 28, 2018, the disclosure of which is hereby incorporated by reference herein in its entirety.

BACKGROUND

1. Technical Field

The present disclosure relates to a liquid ejecting head and a liquid ejecting apparatus.

2. Related Art

A known liquid ejecting head that ejects a liquid from nozzles by increasing pressures inside pressure chambers, in which the liquid is filled, with piezoelectric elements has been proposed. Each of the plurality of piezoelectric elements are electrically coupled to a wiring substrate through wires that are connected to the piezoelectric elements. JP-A-2014-188782 discloses a configuration in which the wiring substrate and the wires are reliably coupled to each other by forming an unevenness in a surface of each wire. For example, a nonconductive adhesive agent (non-conductive paste or NCP) is used to bond the wiring substrate.

In a technique in JP-A-2014-188782, protrusions formed on the surface of each of the plurality of wires are arranged in a direction intersecting the wires. With such a configuration, the flow of the adhesive agent bonding the wiring substrate becomes obstructed easily with the protrusions. Accordingly, there is a problem in that excessive load is needed in mounting the wiring substrate.

SUMMARY

In order to overcome the above issue, a liquid ejecting head according to a suitable aspect of the present disclosure includes a first piezoelectric element that ejects a liquid inside a first pressure chamber from a nozzle, a second piezoelectric element that ejects a liquid inside a second pressure chamber from a nozzle, a first wire that extends in a first direction and that electrically couples the first piezoelectric element and a wiring substrate to each other, and a second wire that is adjacent to the first wire in a second direction intersecting the first direction and that extends in the first direction, the second wire electrically coupling the second piezoelectric element and the wiring substrate to each other. The first protrusion is formed on a surface of the first wire in a mounting area to where the wiring substrate is joined, and a second protrusion is formed on a surface of the second wire in the mounting area and at a position different from that of the first protrusion in the first direction.

DESCRIPTION OF EXEMPLARY EMBODIMENTS

First Embodiment

Figure 1:
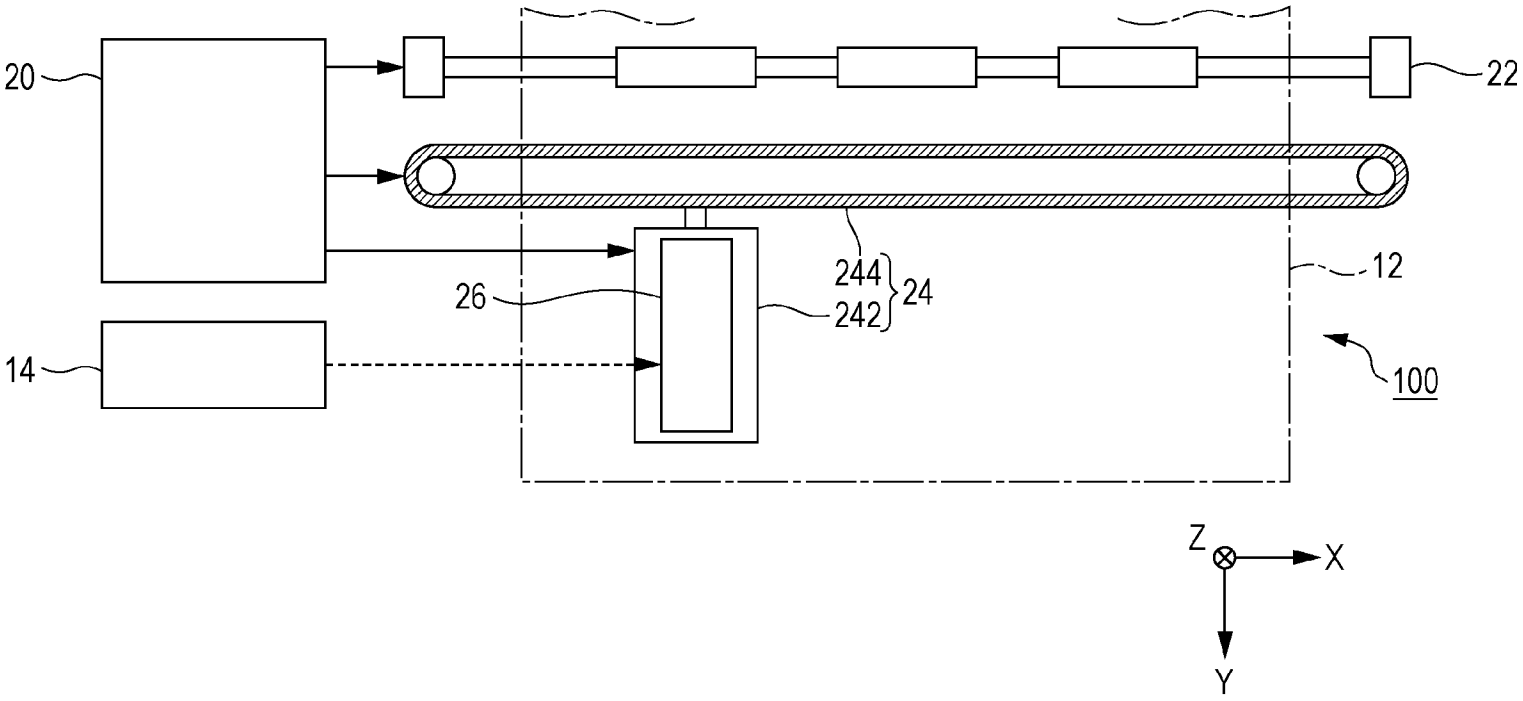
FIG. 1 is a block diagram illustrating, as an example, a configuration of a liquid ejecting apparatus according to a first embodiment.

FIG. 1 is a block diagram illustrating an example of a liquid ejecting apparatus 100 according to a first embodiment. The liquid ejecting apparatus 100 of the first embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100. For example, a cartridge configured to detach from the liquid ejecting apparatus 100, a bag-shaped ink pack formed of a flexible film, or an ink tank into which ink can be refilled is used as the liquid container 14. A plurality of types of inks of different colors or characteristics are stored in the liquid container 14.

As illustrated as an example in FIG. 1, the liquid ejecting apparatus 100 includes a control unit 20, a transport mechanism 22, a moving mechanism 24, and a liquid ejecting head 26. The control unit 20 includes a processing circuit such as a central processing unit (CPU) or a field programmable gate array (FPGA) and a memory circuit such as a semiconductor memory, and controls each element of the liquid ejecting apparatus 100 in an integrated manner. The transport mechanism 22 transports the medium 12 in a Y direction under the control of the control unit 20.

The moving mechanism 24 reciprocates the liquid ejecting head 26 in an X direction under the control of the control unit 20. The X direction is a direction orthogonal to the Y direction in which the medium 12 is transported. The moving mechanism 24 of the first embodiment includes a substantially box-shaped transport body 242 that houses the liquid ejecting head 26 and a transport belt 244 to which the transport body 242 is fixed. Note that a configuration in which a plurality of liquid ejecting heads 26 are mounted in the transport body 242 or a configuration in which the liquid container 14 is mounted in the transport body 242 together with the liquid ejecting head 26 can be adopted.

The liquid ejecting head 26 ejects ink, which is supplied from the liquid container 14, to the medium 12 through a plurality of nozzles (in other words, ejection holes) under the control of the control unit 20. Concurrently with the transportation of the medium 12 performed with the transport mechanism 22 and the repetitive reciprocation of the transport body 242, the liquid ejecting head 26 ejects ink onto the medium 12 to form a desired image on a surface of the medium 12. Note that a direction perpendicular to an XY plane is hereinafter referred to as a Z direction. The direction in which the ink is ejected by the liquid ejecting head 26 corresponds to the Z direction. The XY plane is, for example, a plane parallel to the surface of the medium 12.

Figure 2:
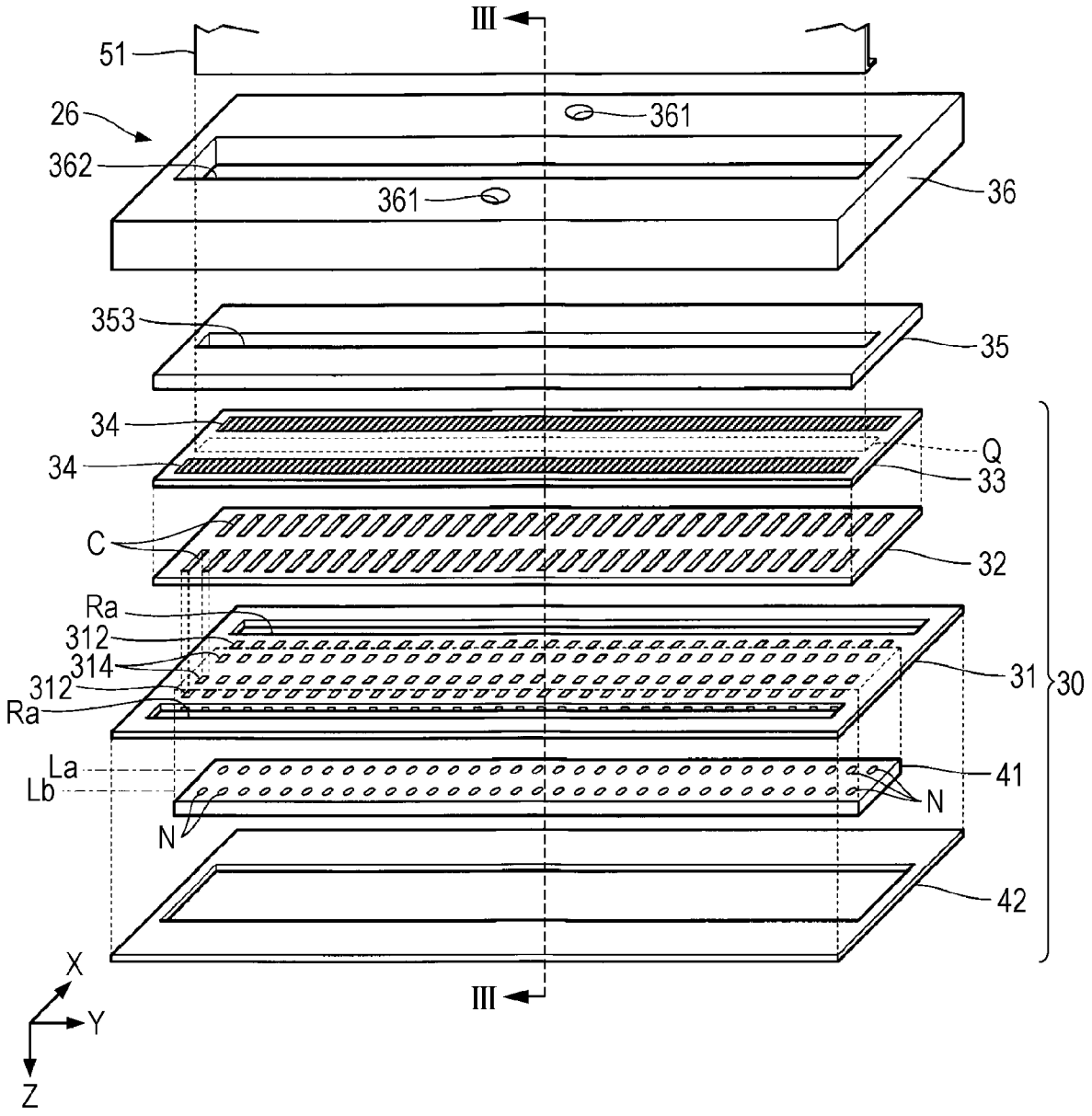
FIG. 2 is an exploded perspective view of a liquid ejecting head.
Figure 3:
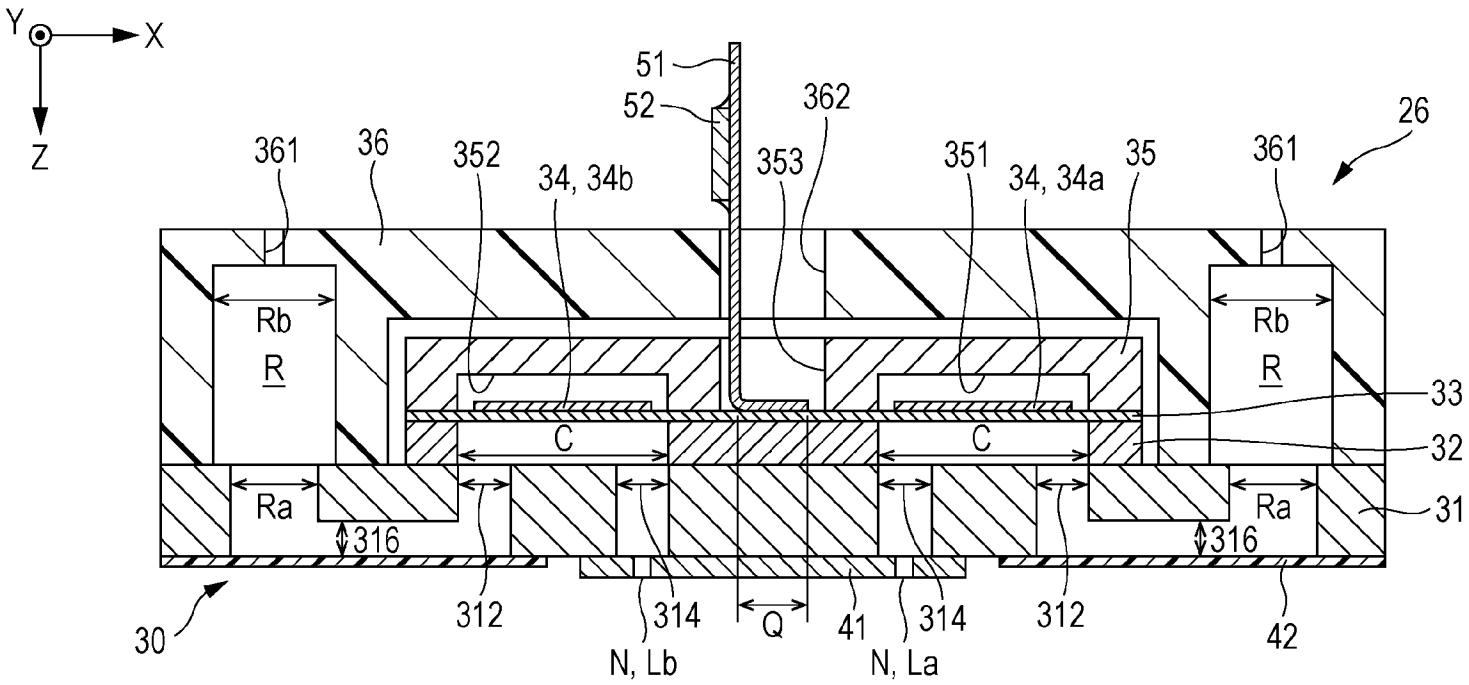
FIG. 3 is a cross-sectional view of the liquid ejecting head.

FIG. 2 is an exploded perspective view of the liquid ejecting head 26, and FIG. 3 is a cross-sectional view taken along line III-III in FIG. 2. As illustrated as an example in FIG. 2, the liquid ejecting head 26 includes a plurality of nozzles N arranged in the Y direction. The plurality of nozzles N of the first embodiment are divided into a first line La and a second line Lb that are arranged side by side with a space in between in the X direction. The first line La and the second line Lb are each a set of a plurality of nozzles N linearly arranged in the Y direction. As it can be understood from FIG. 3, the liquid ejecting head 26 of the first embodiment is structured so that the elements related to each of the nozzles N in the first line La and the elements related to each of the nozzles N in the second line Lb are disposed in a substantially plane symmetric manner. In the following description, the elements corresponding to the first line La will be described mainly and the elements corresponding to the second line Lb will be omitted as appropriate.

As illustrated as an example in FIGS. 2 and 3, the liquid ejecting head 26 includes a flow path structure 30, a plurality of piezoelectric elements 34, a protective plate 35, a housing 36, and a wiring substrate 51. The flow path structure 30 is a structure in which flow paths that supply ink to each of the plurality of nozzles N are formed. The flow path structure 30 of the first embodiment includes a flow path substrate 31, a pressure chamber substrate 32, a diaphragm 33, a nozzle plate 41, and a vibration absorber 42. Each member constituting the flow path structure 30 is a plate-shaped member elongated in the Y direction. The pressure chamber substrate 32 and the housing 36 are provided on a surface of the flow path substrate 31 on the negative side in the Z direction. On the other hand, the nozzle plate 41 and the vibration absorber 42 are provided on a surface of the flow path substrate 31 on the positive side in the Z direction. Each member is fixed with an adhesive agent, for example.

The nozzle plate 41 is a plate-shaped member having the plurality of nozzles N formed therein. Each of the plurality of nozzles N is a circular through hole through which ink is ejected. The nozzle plate 41 is manufactured by processing a single crystal substrate formed of silicon (Si) using a semiconductor manufacturing technique such as, for example, photolithography and etching. However, any known materials and any known manufacturing methods can be adopted to manufacture the nozzle plate 41.

As illustrated in FIGS. 2 and 3, spaces Ra, a plurality of supply flow paths 312, a plurality of communication flow paths 314, and relay liquid chambers 316 are formed in the flow path substrate 31. Each space Ra is an elongated opening formed in the Y direction in plan view viewed in the Z direction, and the supply flow paths 312 and the communication flow paths 314 are each through holes formed for a corresponding nozzle N. Each relay liquid chamber 316 is an elongated space formed in the Y direction across a plurality of nozzles N, and communicates the space Ra and the plurality of supply flow paths 312 to each other. Each of the plurality of communication flow paths 314 overlaps a corresponding single nozzle N in plan view.

As illustrated as an example in FIGS. 2 and 3, a plurality of pressure chambers C are formed in the pressure chamber substrate 32. Each pressure chamber C is formed for each nozzle N and is a space elongated in the X direction in plan view. The plurality of pressure chambers C are arranged in the Y direction. Similar to the nozzle plate 41 described above, for example, the flow path substrate 31 and the pressure chamber substrate 32 are manufactured by processing a single crystal substrate formed of silicon using a semiconductor manufacturing technique. However, any known materials and any known manufacturing methods can be adopted to manufacture the flow path substrate 31 and the pressure chamber substrate 32.

As illustrated as an example in FIG. 2, the diaphragm 33 is provided on a surface of the pressure chamber substrate 32 opposite the flow path substrate 31. The diaphragm 33 of the first embodiment is a plate-shaped member configured to vibrate elastically. Note that portions or the entire diaphragm 33 can be formed so as to be integrated with the pressure chamber substrate 32 by selectively removing the plate-shaped member having a predetermined plate thickness at portions corresponding to the pressure chambers C in the plate thickness direction.

As understood from FIG. 3, the pressure chambers C are spaces located between the flow path substrate 31 and the diaphragm 33. The plurality of pressure chambers C are arranged in the Y direction. As illustrated in FIGS. 2 and 3, the pressure chambers C are in communication with the communication flow paths 314 and the supply flow paths 312. Accordingly, the pressure chambers C are in communication with the nozzles N through the communication flow paths 314 and are in communication with the spaces Ra through the supply flow paths 312 and the relay liquid chambers 316.

The housing 36 is a case that stores the ink supplied to the plurality of pressure chambers C and is, for example, formed of a resin material by injection molding. Spaces Rb, supply holes 361, and an insertion hole 362 are formed in the housing 36. The insertion hole 362 is a through hole elongated in the Y direction. The supply holes 361 are pipe lines through which the ink is supplied from the liquid container 14 and are in communication with the spaces Rb. The spaces Rb of the housing 36 and the spaces Ra of the flow path substrate 31 are in communication with each other. The spaces configured by the space Ra and the space Rb function as liquid storage chambers R that store the ink supplied to the plurality of pressure chambers C.

The ink that has been supplied from the liquid container 14 and that has passed through the supply holes 361 is stored in the liquid storage chambers R. The ink that has been stored in the liquid storage chambers R is branched from the relay liquid chambers 316 to the supply flow paths 312 and is supplied and filled in parallel into the plurality of pressure chambers C. The vibration absorber 42 is a flexible film constituting wall surfaces of the liquid storage chambers R and absorbs the pressure fluctuations of the ink inside the liquid storage chambers R.

As illustrated as an example in FIGS. 2 and 3, the plurality of piezoelectric elements 34 are formed on a surface on a side opposite the nozzles N in the flow path structure 30. Specifically, the plurality of piezoelectric elements 34 are formed on a surface of the diaphragm 33 on a side opposite the pressure chambers C. The piezoelectric element 34 is formed for each pressure chamber C and is a passive element elongated in the X direction in plan view. Each piezoelectric element 34 changes the pressure in the corresponding pressure chamber C by being deformed according to a drive signal supplied from the wiring substrate 51. By having the piezoelectric element 34 change the pressure inside the pressure chamber C, the ink inside the pressure chamber C is ejected from the nozzle N.

Figure 4:
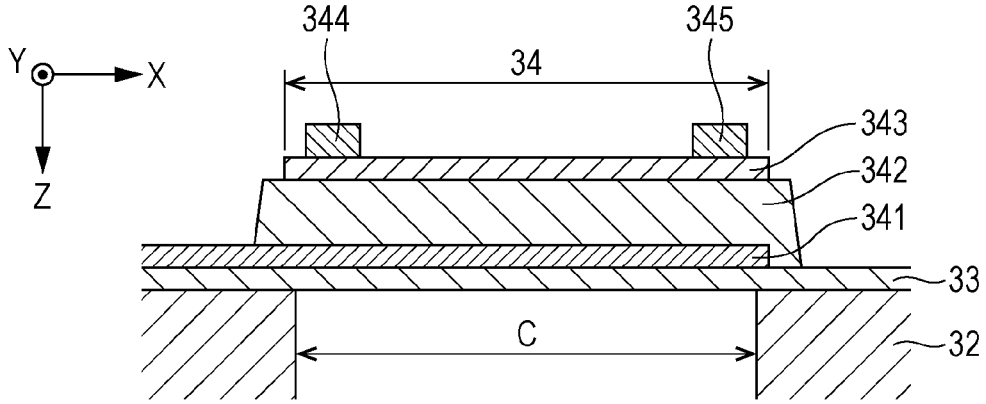
FIG. 4 is a cross-sectional view of a piezoelectric element.

FIG. 4 is a cross-sectional view of a single piezoelectric element 34 corresponding to a nozzle N of the first line La.

As illustrated in FIG. 4, the piezoelectric element 34 is configured of layers including a first electrode 341, a piezoelectric layer 342, and a second electrode 343. The first electrodes 341 are formed on the diaphragm 33. The first electrodes 341 are each an individual electrode formed for the corresponding piezoelectric element 34 and are distanced away from each other. The piezoelectric layer 342 is a ferroelectric piezoelectric material such as, for example, lead zirconate titanate (PZT) formed on a surface of the first electrode 341. The second electrode 343 is formed on a surface of the piezoelectric layer 342. The second electrode 343 of the first embodiment is a strip-like common electrode that is continuous across the plurality of piezoelectric elements 34. A predetermined reference voltage is applied to the second electrode 343.

A conductive layer 344 and a conductive layer 345 spaced apart from each other are formed on a surface of the second electrode 343. The conductive layer 344 and the conductive layer 345 are strip-like electrodes extending in the Y direction across the plurality of piezoelectric elements 34. The conductive layer 344 and the conductive layer 345 are formed of metal having a low resistance such as, for example, gold (Au), and functions as an auxiliary wire that suppresses the voltage in the second electrode 343 from dropping.

Figure 5:
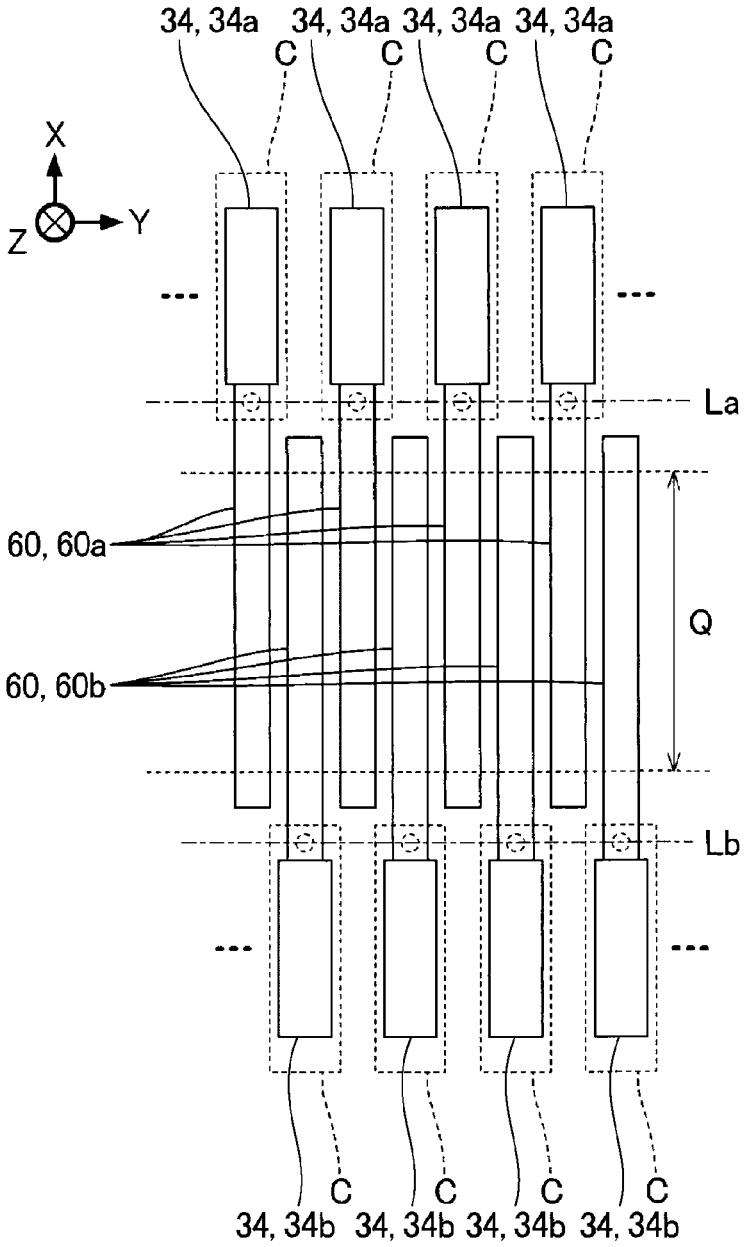
FIG. 5 is a plan view of an area in a flow path structure where the piezoelectric elements are formed illustrated in an enlarged manner.

FIG. 5 is a plan view of an area in the flow path structure 30 where the piezoelectric elements 34 are formed illustrated in an enlarged manner. As illustrated as an example in FIG. 5, the plurality of piezoelectric elements 34 are divided into a plurality of piezoelectric elements 34*a* corresponding to the first line La, and a plurality of piezoelectric elements 34*b* corresponding to the second line Lb. The plurality of piezoelectric elements 34*a* and the plurality of piezoelectric elements 34*b* are arranged parallel to each other with a space in between in the X direction.

As illustrated in FIGS. 2 and 3, the protective plate 35 is a plate-shaped member elongated in the Y direction. The protective plate 35 is manufactured by processing a single crystal substrate formed of silicon using a semiconductor manufacturing technique, for example. However, the manufacturing method and the material of the protective plate 35 are not limited to the example described above.

An accommodation portion 351 corresponding to the first line La and an accommodation portion 352 corresponding to the second line Lb are formed in the protective plate 35. The accommodation portion 351 and the accommodation portion 352 are cavities long in the Y direction formed in a surface, among the surfaces of the protective plate 35, opposing the flow path structure 30. The plurality of piezoelectric elements 34*a* are accommodated in the accommodation portion 351, and the plurality of piezoelectric elements 34*b* are accommodated in the accommodation portion 352. The protective plate 35 exerts a function of preventing moisture or external air from adhering to the piezoelectric elements 34 and a function of reinforcing the mechanical strength of the flow path structure 30. An insertion hole 353 elongated in the X direction is formed in the protective plate 35 of the first embodiment. The insertion hole 353 is a through hole formed between the accommodation portion 351 and the accommodation portion 352.

The wiring substrate 51 is a mounted component that electrically couples the liquid ejecting head 26 and the control unit 20 to each other. A flexible connecting component such as, for example, a flexible printed circuit (FPC) or a flexible flat cable (FFC) is, desirably, used as the wiring substrate 51. As illustrated as an example in FIG. 3, a drive circuit 52 is mounted on the wiring substrate 51 of the first embodiment. The drive circuit 52 is an IC chip that outputs the drive signal to drive the piezoelectric elements 34 and the reference voltage. The drive signal output from the drive circuit 52 is supplied to the piezoelectric elements 34 through wiring of the wiring substrate 51. As illustrated as an example in FIGS. 2 and 3, the wiring substrate 51 is inserted into the insertion hole 362 of the housing 36 and the insertion hole 353 of the protective plate 35, and an end portion of the wiring substrate 51 is joined to the flow path structure 30. Specifically, the end portion of the wiring substrate 51 is joined to the surface of the diaphragm 33.

As understood through FIG. 1, an area Q illustrated as an example in FIG. 5 is a mounting area to where the end portion of the wiring substrate 51 is joined. The mounting area Q is a partial area of the surface of the diaphragm 33 on the side opposite the pressure chambers C. Specifically, the mounting area Q corresponds to a strip-like area elongated in the Y direction between the plurality of piezoelectric elements 34*a* corresponding to the first line La and the plurality of piezoelectric elements 34*b* corresponding to the second line Lb.

As illustrated as an example in FIG. 5, a plurality of wires 60 are formed in the mounting area Q. The plurality of wires 60 are formed so as to be spaced apart from each other in the Y direction. A wire 60 is formed for each piezoelectric element 34 and extends linearly in the X direction. A single wire 60 corresponding to any one of the piezoelectric elements 34 is a lead wire that electrically couples the piezoelectric element 34 to the wiring substrate 51. The plurality of wires 60 are formed from the same layer as those of the conductive layer 344 and the conductive layer 345. In other words, by selectively removing a conductive film having a predetermined film thickness, the conductive layer 344, the conductive layer 345, and the plurality of wires 60 are formed integrally. Accordingly, the wires 60 are formed of metal such as gold (Au) having a low resistance. Note that the X direction in the first embodiment is an example of a "first direction" and the Y direction is an example of a "second direction".

As illustrated as an example in FIG. 5, the plurality of wires 60 include wires 60*a* coupled to the piezoelectric elements 34*a* corresponding to the first line La, and wires 60*b* coupled to piezoelectric elements 34*b* corresponding to the second line Lb. Specifically, the wires 60*a* and the wires 60*b* are arranged alternately in the Y direction. End portions of the wires 60*a* on the positive side in the X direction are electrically coupled to the first electrodes 341 of the piezoelectric elements 34*a*. On the other hand, end portions of the wires 60*b* on the negative side in the X direction are electrically coupled to the first electrodes 341 of the piezoelectric elements 34*b*. The piezoelectric elements 34*a* are examples of "first piezoelectric elements" and the pressure chambers C corresponding to the piezoelectric elements 34*a* are examples of "first pressure chambers". Furthermore, the piezoelectric elements 34*b* are examples of "second piezoelectric elements" and the pressure chambers C corresponding to the piezoelectric elements 34*b* are examples of "second pressure chambers".

Figure 6:
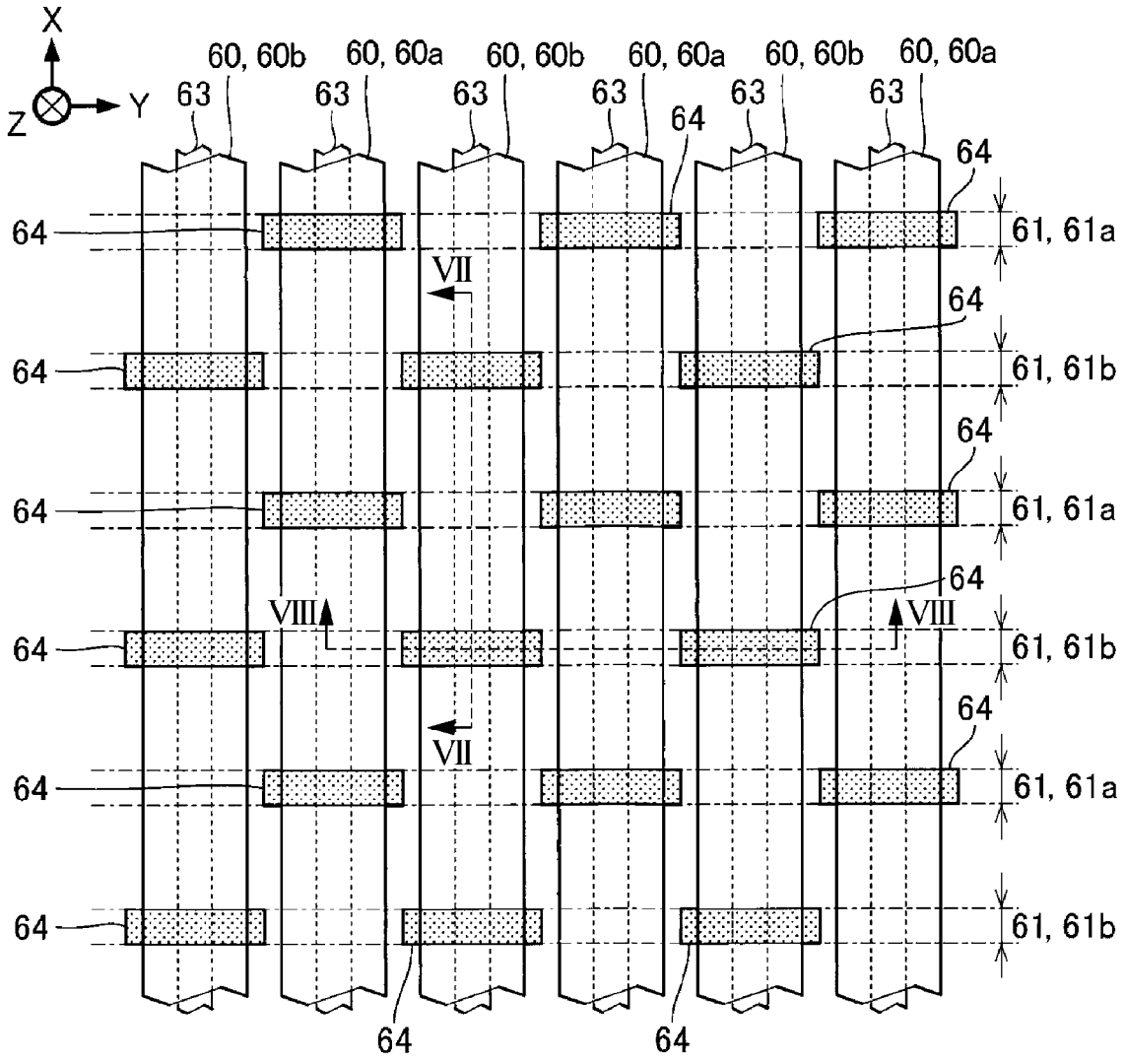
FIG. 6 is a plan view illustrating an enlarged mounting area.
Figure 7:
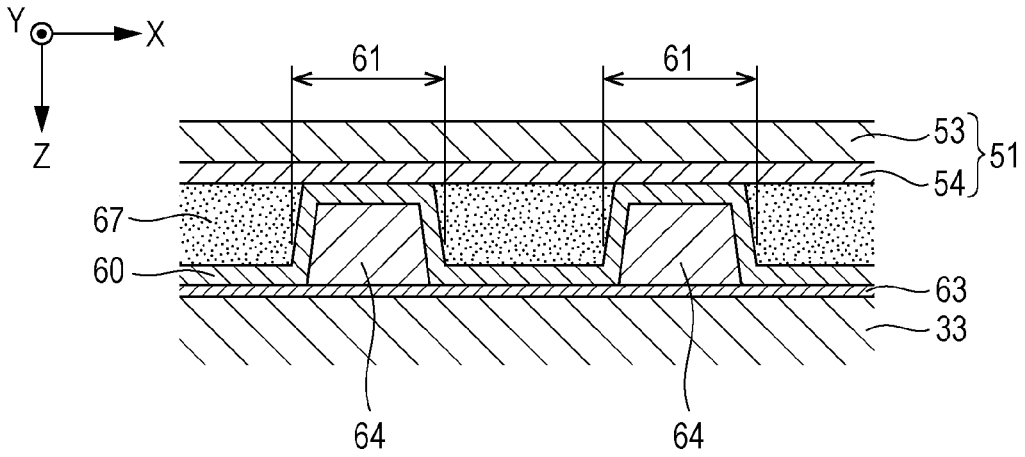
FIG. 7 is a cross-sectional view taken along line VII-VII in FIG. 6.
Figure 8:
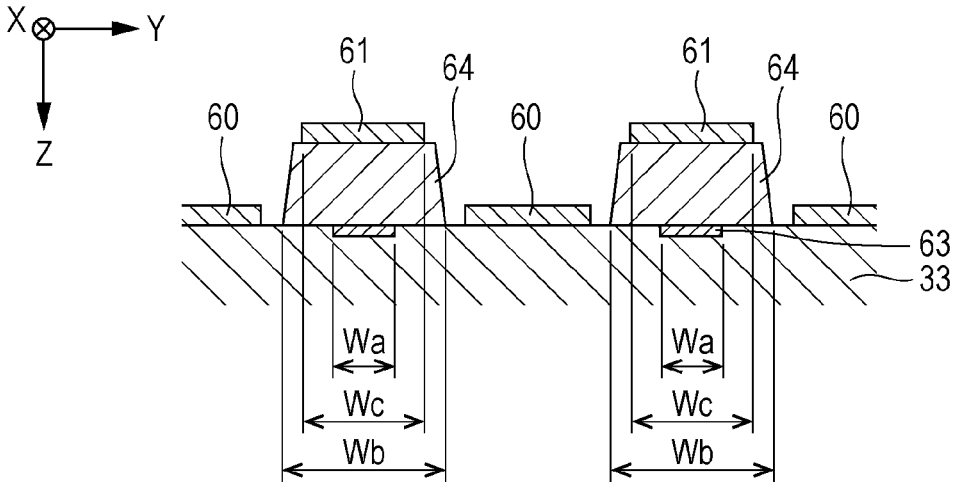
FIG. 8 is a cross-sectional view taken along line VIII-VIII in FIG. 6.

FIG. 6 is a plan view of the plurality of wires 60 in the mounting area Q illustrated in an enlarged manner. FIG. 7 is a cross-sectional view taken along line VII-VII in FIG. 6, and FIG. 8 is a cross-sectional view taken along line VIII-VIII in FIG. 6. As illustrated as an example in FIGS. 6 to 8, a plurality of protrusions 61 are formed on a surface of each of the plurality of wires 60. The protrusions 61 are portions protruding to the negative side in the Z direction compared with other portions of the wires 60. The plurality of protrusions 61 formed on any one of the wires 60 are arranged so as to be spaced apart along the wire 60 in the Y direction. The intervals of the protrusions 61 in any one of the wires 60 are the same, and the number and the intervals of the protrusions 61 are the same throughout the plurality of wires 60.

The portion of the wiring substrate 51 joined to the mounting area Q is also illustrated in FIG. 7 for convenience sake. As illustrated as an example in FIG. 7, the wiring substrate 51 includes a flexible base material 53 formed of an elastic material such as polyimide, and a plurality of wires 54 formed on a surface of the base material 53. The wiring substrate 51 is bonded to the mounting area Q with an adhesive agent 67 so that the plurality of wires 54 of the wiring substrate 51 are electrically coupled to the plurality of wires 60 of the mounting area Q. The adhesive agent 67 used to bond the wiring substrate 51 in the first embodiment is a nonconductive adhesive agent (NPC). As illustrated as an example in FIG. 7, in a state in which surfaces of the protrusions 61 of the wires 60 are adhered to the surfaces of the wires 54 of the wiring substrate 51, the wiring substrate 51 is bonded to the mounting area Q with the adhesive agent 67 filled in the spaces between the protrusions 61.

Note that in a configuration in which the surfaces of the wires 60 are simple flat surfaces throughout the entire surfaces, due to the surface roughness, for example, the surfaces of the wires 60 and the surfaces of the wires 54 of the wiring substrate 51 may not be sufficiently adhered to each other. When a conductive adhesive agent is used in mounting the wiring substrate 51, sufficient adhesion between the surfaces of the wires 60 and the surfaces of the wires 54 is not required; however, when a nonconductive adhesive agent is used, sufficient electric connections between the wires 60 and the wires 54 may not be obtained if the wires 60 and the wires 54 are not sufficiently adhered to each other. Since the plurality of protrusions 61 are formed on the wires 60 in the first embodiment, the nonconductive adhesive agent is situated not only between each space between two wires 60 adjacent to each other in the Y direction but also in each space between two protrusions 61 adjacent to each other in the X direction. According to the above configuration, since the surfaces of the protrusions 61 sufficiently adhere to the surfaces of the wires 54 of the wiring substrate 51, electric connections between the wires 60 and the wires 54 are obtained sufficiently. Accordingly, even when a nonconductive adhesive agent is used to mount the wiring substrate 51, connection failure between the wires 60 and the wiring substrate 51 can be suppressed. In the first embodiment in particular, since the plurality of protrusions 61 are formed on each of the wires 60, compared with a configuration in which a single protrusion 61 alone is formed on each wire 60, the effect of suppressing the connection failure between the wires 60 and the wiring substrate 51 is markedly noticeable.

As illustrated as an example in FIGS. 6 to 8, underlayer portions 63 and base portions 64 are formed in the mounting area Q. The underlayer portion 63 is formed for each wire 60, and the base portion 64 is formed for each protrusion 61. The underlayer portions 63 are each a strip-like thin film extending in the X direction. As illustrated as an example in FIG. 8, a width Wa of each underlayer portion 63 in the Y direction is smaller than a width We of each wire 60 in the Y direction. The underlayer portions 63 are, for example, formed from a layer that is the same as that of the first electrodes 341 of the piezoelectric elements 34. In other words, by selectively removing a conductive film having a predetermined film thickness, the first electrodes 341 and the underlayer portions 63 are formed integrally.

When viewed in plan view in the Z direction, the base portions 64 are island-shaped portions formed so as to overlap the underlayer portions 63. The base portions 64 of the first embodiment are each formed so as to have an elongated shape extending in the Y direction. The base portion 64 is an insulating layer formed of a layer that is the same as that of the piezoelectric layer 342 of the piezoelectric elements 34. In other words, by selectively removing a dielectric film having a predetermined film thickness, the piezoelectric layer 342 and the base portions 64 are formed integrally. As described above, by forming the base portions 64 so as to overlap the underlayer portions 63, the base portions 64 adhere to the surface of the underlayer portions 63; accordingly, the possibility of the base portions 64 peeling off can be reduced.

By forming the wires 60 so as to overlap the base portions 64, the protrusions 61 reflecting the shapes of the base portions 64 are formed on the surfaces of the wires 60. In other words, the protrusions 61 of the wires 60 are portions positioned above the surfaces of the base portions 64 in the wires 60. As illustrated in FIG. 8, a width Wb of the base portion 64 in the Y direction is larger than the width Wc of the wire 60 in the Y direction. In other words, end portions of the base portions 64 protrude in the Y direction from edges of the wires 60 in plan view. As described above, in a configuration in which the base portion 64 is formed wider than the wire 60, even if there were an error in the position of the wire 60 in the Y direction, the wire 60 will overlap the base portion 64. Accordingly, the protrusions 61 of the wires 60 can be formed appropriately.

As illustrated as an example in FIG. 6, the positions of the protrusions 61 in the X direction in two wires 60 adjacent to each other in the Y direction differ. For example, attention is given to any of the wires, that is, a wire 60*a* and a wire 60*b*, adjacent to each other in the X direction. The wire 60*a* is, for example, a wire 60 that electrically couples the piezoelectric element 34*a* corresponding to the first line La to the wiring substrate 51, and the wire 60*b* is, for example, a wire 60 that electrically couples the piezoelectric element 34*b* corresponding to the second line Lb to the wiring substrate 51. The wire 60*a* is an example of a "first wire" and the wire 60*b* is an example of a "second wire". In the following description, the reference numerals of the protrusions 61*a* formed in the wires 60*a* and the reference numerals of the protrusions 61*b* formed in the wire 60*b* will be distinguished for convenience sake. The protrusion 61*a* of the wire 60*a* is an example of a "first protrusion" and a protrusion 61*b* of the wire 60*b* is an example of a "second protrusion".

As illustrated as an example in FIG. 6, the positions of the protrusions 61*a* of the wires 60*a* and the protrusions 61*b* of the wires 60*b* are different in the X direction. In other words, the protrusions 61*a* and the protrusions 61*b* are formed at positions that are shifted in the X direction. In other words, it may be said that the positions of the base portions 64 in the wires 60*a* and those in the wires 60*b* are different. The base portion 64 overlapping the wire 60*a* is an example of a "first base portion" and the base portion 64 overlapping the wire 60*b* is an example of a "second base portion".

The positions of the protrusion 61*a* in the X direction are between two protrusions 61*b* on the corresponding wire 60*b* adjacent to each other in the X direction. For example, the positions of the protrusions 61*a* in the X direction are where midpoints of two adjacent protrusions 61*b* on the corresponding wire 60*b* are positioned. Similarly, the positions of the protrusions 61*b* in the X direction are between two protrusions 61*a* on the corresponding wire 60*a* adjacent to each other in the X direction and are, for example, where midpoints of two adjacent protrusions 61*a* are positioned. As understood from the description above, in the first embodiment, the plurality of protrusions 61 of the wires 60 are disposed in a zigzag manner or in a staggered manner.

As described above, in the first embodiment, the positions of the protrusions 61 of two wires 60 adjacent to each other in the Y direction are different in the X direction. Accordingly, compared with a configuration (hereinafter, referred to as a "comparative example") in which the positions of the protrusions 61 in the X direction of two wires 60 adjacent to each other in the Y direction are the same, large spaces between the protrusions 61*a* and the protrusions 61*b* are obtained. According to the above configuration, the adhesive agent 67 that bonds the wiring substrate 51 to the mounting area Q can flow more easily compared with the comparative example. Accordingly, there is an advantage in that the load needed to mount the wiring substrate 51 is reduced.

Furthermore, in a configuration in which the base portions 64 of two wires 60 adjacent to each other in the Y direction are continuous in the Y direction, the conductive material constituting the wire 60 or moisture close by is diffused along the base portions 64. Accordingly, there is a possibility of short circuiting ultimately occurring between the two wires 60 adjacent to each other in the Y direction. The first embodiment also has an advantage in that, since the base portions 64 in the two wires 60 adjacent to each other in the Y direction are separated from each other, short circuiting of the two wires 60 owing to the base portions 64 can be suppressed effectively.

Furthermore, in the first embodiment, since the wires 60 are formed on the surfaces of the base portions 64, the protrusions 61 reflecting the shapes of the base portions 64 are formed in the wires 60. Accordingly, there is an advantage in that the formation of the protrusions 61 in the wires 60 is facilitated.

Second Embodiment

A description of a second embodiment will be given. Note that in the following examples, elements having functions similar to those of the first embodiment will be denoted by applying the reference numerals used in the description of the first embodiment, and detailed description of the elements will be omitted appropriately.

Figure 9:
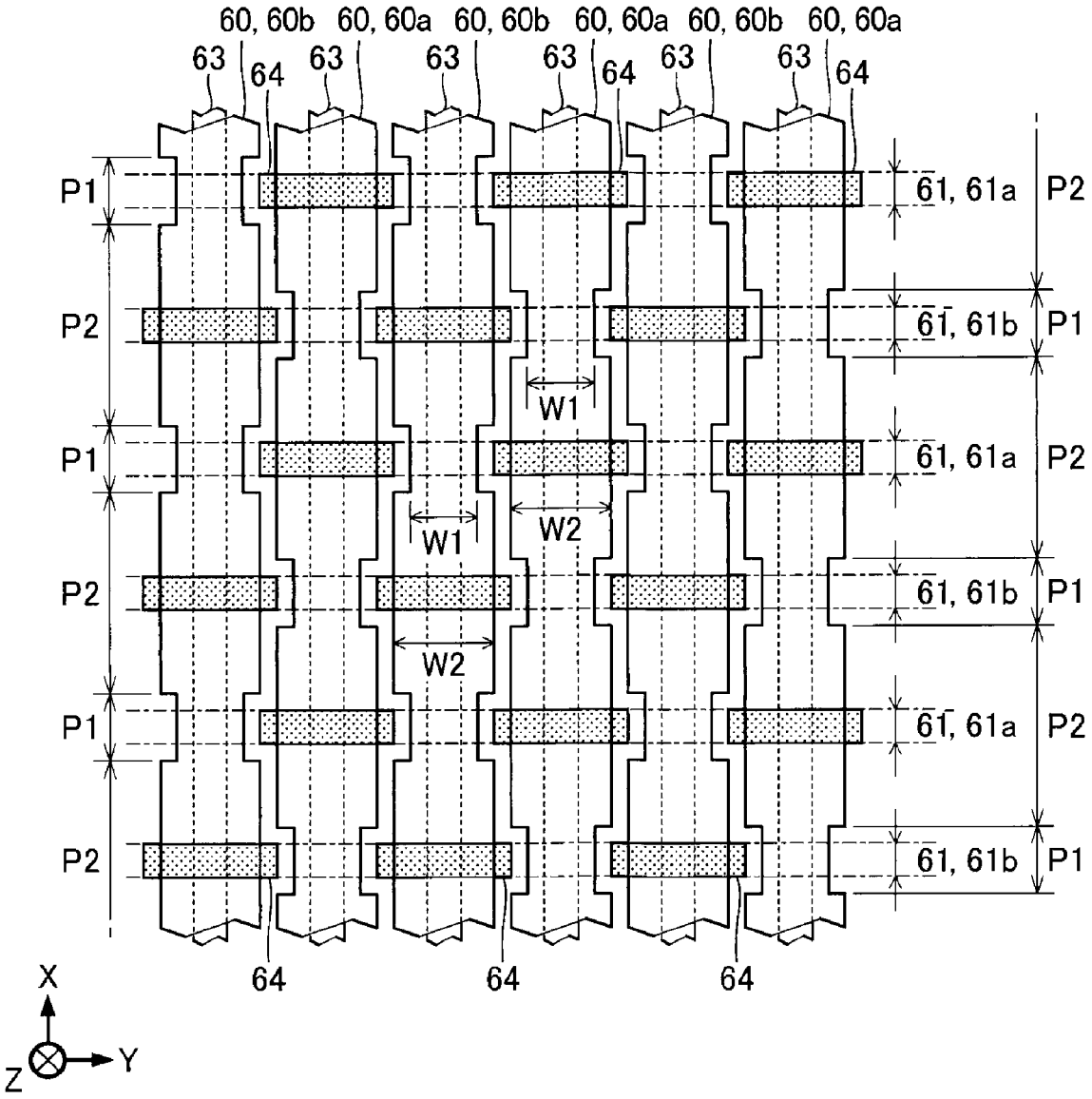
FIG. 9 is a plan view illustrating an enlarged mounting area according to a second embodiment.

FIG. 9 is a plan view of the plurality of wires 60 in the mounting area Q illustrated in an enlarged manner, according to the second embodiment. As illustrated as an example in FIG. 9, each of the plurality of wires 60 according to the second embodiment is divided into first portions P1 and second portions P2. Specifically, the wires 60 are configured so that each first portion P1 and each second portion P2 are arranged alternatively in the X direction.

When attention is given to the wire 60*a* and the wire 60*b* adjacent to each other in the Y direction, the first portions P1 of the wire 60*a* and the base portions 64 of the wire 60*b* are adjacent to each other, and the first portions P1 of the wire 60*b* and the base portions 64 of the wire 60*a* are adjacent to each other. In other words, the first portions P1 of the wire 60*a* are positioned between the base portions 64 of the wire 60*b* adjacent to the above wire 60*a* on one side and the base portions 64 of the wire 60*b* adjacent to the above wire 60*a* on the other side. Similarly, the first portions P1 of the wire 60*b* are positioned between the base portions 64 of the wire 60*a* adjacent to the above wire 60*b* on one side and the base portions 64 of the wire 60*a* adjacent to the above wire 60*b* on the other side. The second portions P2 of each wire 60 are portions other than the first portions P1 in each wire 60. A dimension of each first portion P1 in the X direction is smaller than a dimension of each second portion P2 in the X direction. Furthermore, the dimension of each first portion P1 in the X direction is larger than a dimension of each base portion 64 in the X direction.

As illustrated as an example in FIG. 9, a width W1 of each first portion P1 of each wire 60 is smaller than a width W2 of each second portion P2 of each wire 60. In other words, the first portions P1 of each wire 60 are narrowed portions corresponding to the base portions 64 of the other wires 60 adjacent to the above wire 60. In other words, it may be said that the edges of each wire 60 each have a shape detouring the base portions 64 of the other wires 60 adjacent to the above wire 60 and cut in the dimension is performed.

An effect similar to the first embodiment can be provided in the second embodiment as well. Furthermore, since the widths W1 of the first portions P1 in the wires 60 are smaller than the widths W2 of the second portions P2, the second embodiment has an advantage in that, compared with the first embodiment, the intervals between the wires 60 can be reduced while separating each wire 60 and the base portions 64 of the other wires 60 adjacent to the wire 60 from each other. By having the widths W1 of the first portions P1 be smaller than the width W2 of the second portions P2, the wires 60 and the base portions 64 are separated from each other; accordingly, the effect described above in that short circuiting of two wires 60 adjacent to each other can be suppressed is markedly noticeable.

Figure 10:
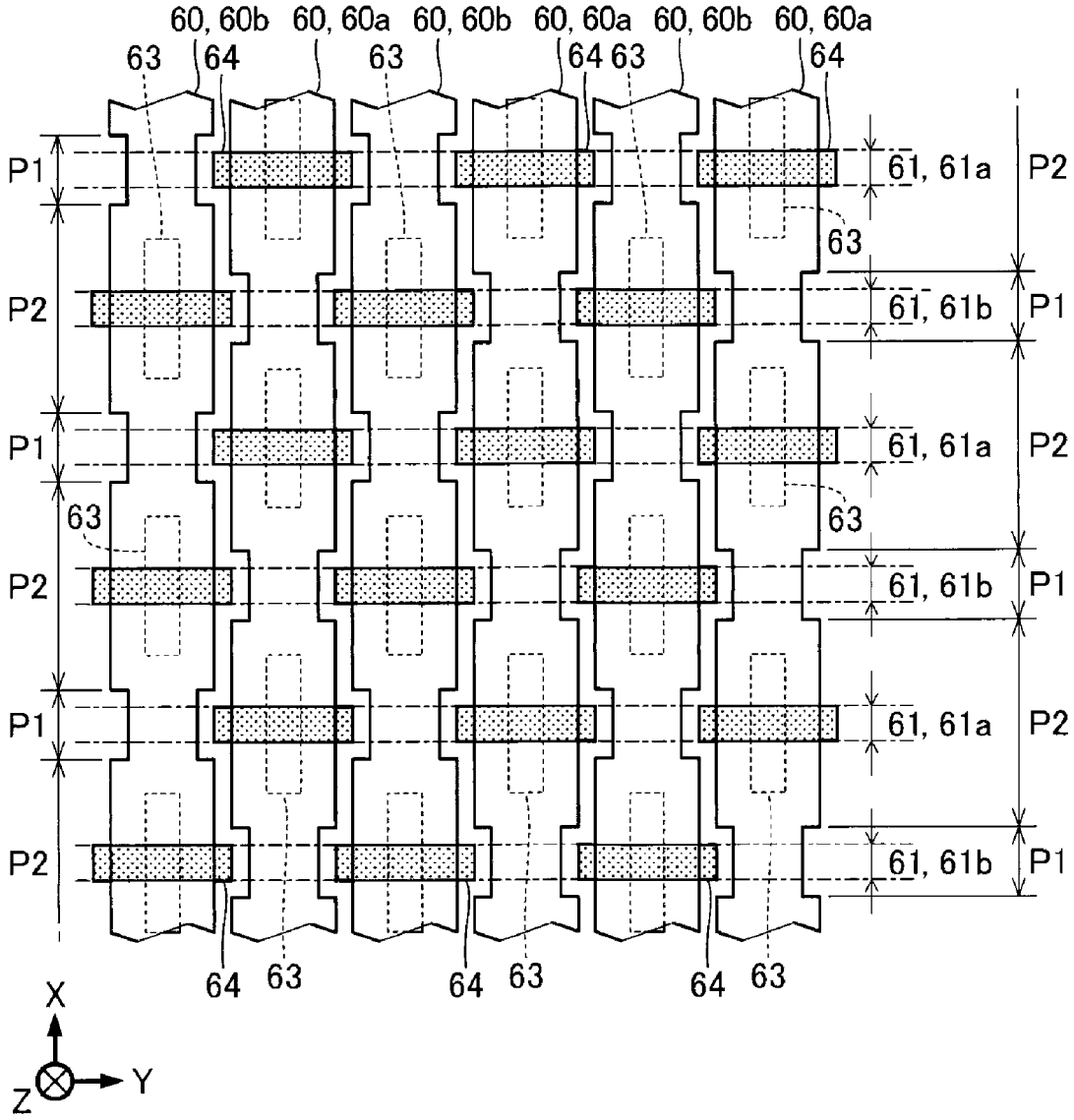
FIG. 10 is a plan view illustrating an enlarged mounting area according to a modification of the second embodiment.

Note that in FIG. 9, similar to the first embodiment, the underlayer portions 63 extending along the wires 60 in a linear manner in the X direction have been described as an example; however, as illustrated in FIG. 10, an island-shaped underlayer portion 63 may be formed individually for each base portion 64.

Third Embodiment

Figure 11:
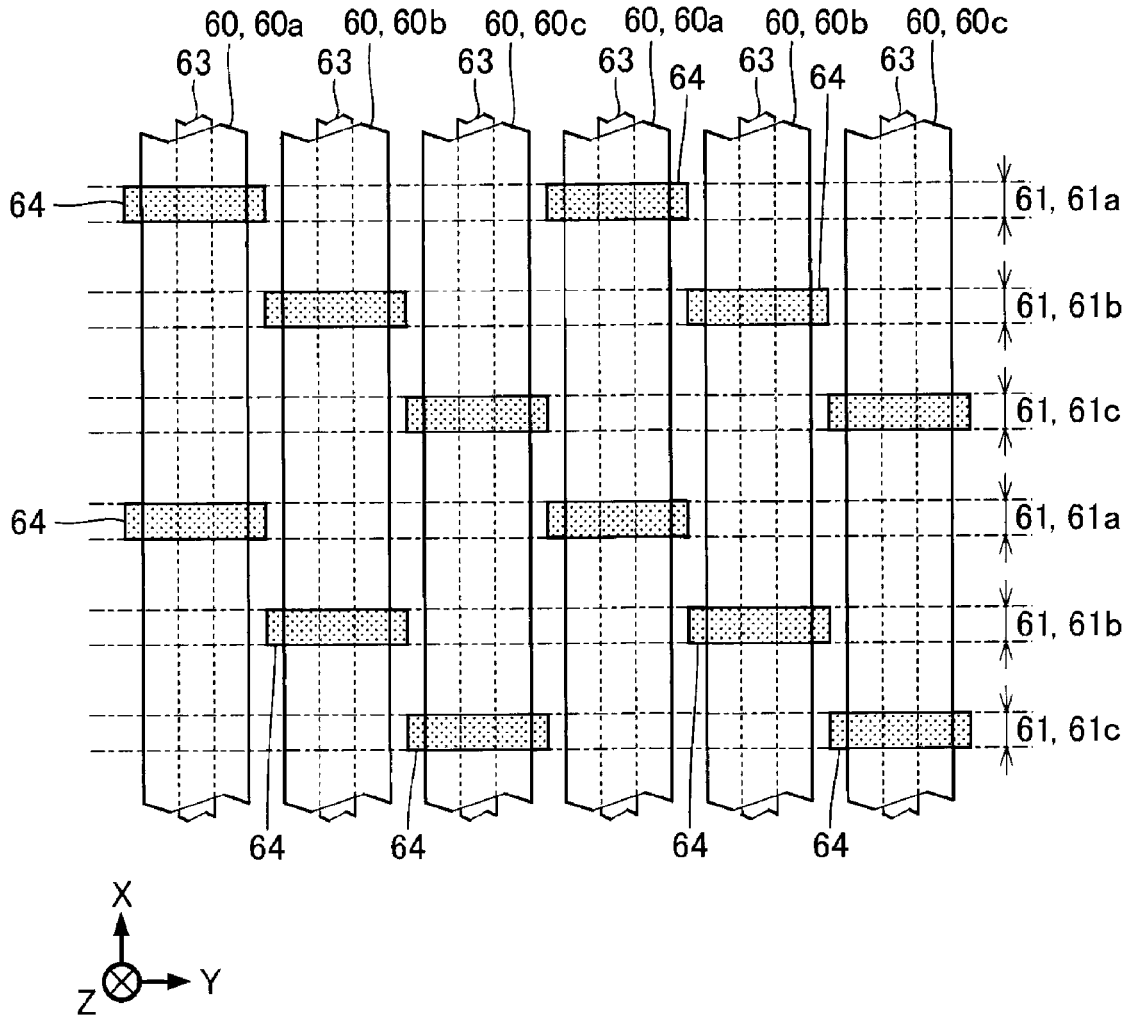
FIG. 11 is a plan view illustrating an enlarged mounting area according to a third embodiment.

FIG. 11 is a plan view of the plurality of wires 60 in the mounting area Q illustrated in an enlarged manner, according to a third embodiment. As illustrated in FIG. 11, attention is given to any of the wires, that is, a wire 60*a*, a wire 60*b*, and a wire 60*c* adjacent to each other in the Y direction. When the three wires, that is, wire 60*a*, the wire 60*b*, and the wire 60*c* are referred to as a unit, a plurality of units are arranged in the Y direction.

In the first embodiment, a configuration in which the positions of the protrusions 61*a* of the wires 60*a* and the positions of the protrusions 61*b* of the wires 60*b* are different in the X direction has been described as an example. In the third embodiment, the positions of the protrusions 61*a* of the wires 60*a*, the positions of the protrusions 61*b* of the wires 60*b*, and the positions of the protrusions 61*c* of the wires 60*c* are different in the X direction. In other words, while in the second embodiment, the protrusions 61*a* of the wires 60*a* and the protrusions 61*b* of the wires 60*b* are two rows arranged in a zigzag manner, in the third embodiment, the protrusions 61*a* of the wires 60*a*, the protrusions 61*b* of the wires 60*b*, and the protrusions 61*c* of the wires 60*c* are three rows arranged in a zigzag manner.

An effect similar to that of the first embodiment can be provided in the third embodiment as well. Note that while in FIG. 11, a configuration in which the width of the wires 60 are uniform across the entire length of the wires 60 have been illustrated as an example, the configuration of the second embodiment in which the widths W1 of the first portions P1 and the widths W2 of the second portions P2 of the wires 60 are different may be applied to the third embodiment. Furthermore, four or more wires 60 may serve as a unit, and the positions of the protrusions 61 in the wires 60 in each unit may be differed in the X direction.

Modifications

The various embodiments described above as examples can be modified in various ways. Specific modification modes that can be applied to the embodiments described above will be described below as examples. Two or more optionally selected modes from the examples below can be merged as appropriate as long as they do not contradict each other.

(1) While in the embodiments described above, the plurality of protrusions 61 are formed on the surfaces of the wires 60 at equal intervals, the interval between two protrusions 61 adjacent to each other in the X direction is optional. In other words, the configuration in which the plurality of protrusions 61 of the wires 60 are arranged at equal intervals is not essential.

(2) While in the embodiments described above, the first electrodes 341 of the piezoelectric elements 34 are individual electrodes and the second electrodes 343 are common electrodes, the first electrodes 341 may be common electrodes and the second electrodes 343 may be individual electrodes. In the configuration in which the second electrodes 343 are individual electrodes, the wires 60 are electrically coupled to the second electrodes 343 of the piezoelectric elements 34. Alternatively, both the first electrodes 341 and the second electrodes 343 may be individual electrodes.

(3) While in the embodiments described above, the plurality of wires 60 are formed in the mounting area Q between the plurality of piezoelectric elements 34*a* and the plurality of piezoelectric elements 34*b*, the plurality of piezoelectric elements 34 may be formed only in an area on one side of the mounting area Q in the X direction. In other words, the configuration in which the plurality of wires 60 are alternatively drawn out to the positive side and the negative side in the X direction is omitted.

(4) While in the embodiments described above, the wires 60, the underlayer portions 63, and the base portions 64 are formed from a layer that is the same as that constituting the piezoelectric elements 34, the wires 60, the underlayer portions 63, and the base portions 64 may be formed at a process different from the process of manufacturing the piezoelectric elements 34.

(5) While in the embodiments described above, the protrusions 61 are formed on the surfaces of the wires 60 by forming the wires 60 on the surface of the flow path structure 30 on which the base portions 64 are formed, the method or the configuration of forming the protrusions 61 is not limited to the examples described above. For example, a specific portion of a conductive film formed with a predetermined film thickness may be removed in the film thickness direction and portions other than the above portion may be formed as the protrusions 61. As understood from the above description, the underlayer portions 63 and the base portions 64 can be omitted.

(6) While in the embodiments described above, the serial type liquid ejecting apparatus 100 in which the transport body 242 in which the liquid ejecting head 26 is mounted is reciprocated has been described as an example, a line type liquid ejecting apparatus in which a plurality of nozzles N are distributed across the entire width of the medium 12 can also be applied to the present disclosure.

(7) The liquid ejecting apparatus 100 described as an example in the embodiments described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a first piezoelectric element that ejects a liquid inside a first pressure chamber from a nozzle;

a second piezoelectric element that ejects a liquid inside a second pressure chamber from a nozzle;

a first wire that extends in a first direction and that electrically couples the first piezoelectric element and a wiring substrate to each other; and a second wire that is adjacent to the first wire in a second direction intersecting the first direction and that extends in the first direction, the second wire electrically coupling the second piezoelectric element and the wiring substrate to each other, wherein a first protrusion is formed on a surface of the first wire in a mounting area to where the wiring substrate is joined, wherein a second protrusion is formed on a surface of the second wire in the mounting area and at a position different from that of the first protrusion in the first direction, wherein a first base and a second base are formed in the mounting area at positions different from each other in the first direction, wherein the first protrusion is a portion of the first wire positioned on a surface of the first base, and wherein the second protrusion is a portion of the second wire positioned on a surface of the second base.

2. The liquid ejecting head according to claim 1, wherein in the second direction, a width of the first base is larger than a width of the first wire, and in the second direction, a width of the second base is larger than a width of the second wire.

3. The liquid ejecting head according to claim 2, wherein a width of a first portion of the first wire adjacent to the second base in the second direction is smaller than a width of a second portion that is a portion of the first wire other than the first portion.

4. The liquid ejecting head according to claim 1, wherein a plurality of first protrusions are formed on the first wire, a plurality of second protrusions are formed on the second wire, and positions of the first protrusions in the first direction and positions of the second protrusions in the first direction are different from each other.

5. A liquid ejecting apparatus comprising:

the liquid ejecting head according to claim 1.

* * * * *